US006112504A

United States Patent [19]

McGregor et al.

[11] Patent Number: 6,112,504

[45] Date of Patent: Sep. 5, 2000

[54] BULK BAGGING MACHINE

[75] Inventors: James R. McGregor, Lakeville; Harold McGregor, Owatonna; John McGregor, Morristown; Tracy J. Steiger, Owatonna, all of Minn.

[73] Assignee: Slidell, Inc., Owatonna, Minn.

[21] Appl. No.: 09/261,315

[22] Filed: Mar. 3, 1999

[51] Int. Cl.[7] ..... B65B 51/00

[52] U.S. Cl. ..... 53/417; 53/175; 53/138.4; 53/284.7; 53/469; 53/370; 141/114; 141/10; 141/166; 141/314; 141/317

[58] Field of Search ..... 53/576, 175, 284.7, 53/370, 138.3, 138.4, 139.1, 473, 469, 483, 417, 459; 141/114, 313, 314, 317, 166, 10

[56] References Cited

U.S. PATENT DOCUMENTS 4,676,284 6/1987 DeCane .
4,872,493 10/1989 Everman ..... 141/114
5,036,893 8/1991 DeCane .
5,787,945 8/1998 Iemersma ..... 141/114

*Primary Examiner*—Peter Vo
*Assistant Examiner*—Louis Huynh
*Attorney, Agent, or Firm*—Moore & Hansen

[57] ABSTRACT

A bag filling machine comprising a supply hopper, a material flow control mechanism and a rotatable bag filling spout is herein disclosed. The rotating bag filling spout is constructed and arranged for rotation about a vertical axis and is connected to the supply hopper through the material flow control mechanism so as to convey bulk commodities stored in the supply hopper into a bag that is to be filled. After the bag has been filled, the rotatable bag filling spout rotates to close the bag. A sealing mechanism is also provided to seal the filled bags once they have been closed by the rotating bag filling spout.

37 Claims, 6 Drawing Sheets

BULK BAGGING MACHINE

BACKGROUND OF THE INVENTION

This invention relates to machines for rapidly and accurately filling large, bulk material bags. More specifically, the present invention is drawn to a novel spout mechanism for securely holding an open mouth of a bulk material bag during filling and for twisting the open mouth of the bulk material bag closed prior to sealing the open mouth of the bag.

1. Field of the Invention

Bulk bags are a simple and desirable means for transporting large quantities of materials. Bulk bags are available in myriad sizes, shapes and materials and may be used to transport such things as dry chemicals, building materials, food items such as flour, feeds, and the like. These bags take up little space when empty and are sufficiently strong to contain and transport quantities of materials on the order of two thousand pounds. Bulk bags are best suited for the transport of flowable materials that can be essentially poured into a bag through its top. Though possible, bulk bags are not generally used to transport liquids. FIG. 1 illustrates a typical prior art bulk bag 14 of the type that may be filled by the present invention.

As can be seen in FIG. 1, a bulk bag 14 has an outer shell 14*a* with a plurality of bag support loops 18*a* sewn to its upper surface. The outer shell 14*a* of the bulk bag 14 has an opening in its upper surface through which extends an elongated neck 18 or top of an inner liner 19. The inner liner has substantially the same shape as the outer shell 14*a*. The outer shell 14*a* generally is arranged to resist the majority of the pressure applied to the bag wall by the material that fills the bag 14. The inner liner of the bag 14, on the other hand, acts as a membrane to prevent the material filling the bag 14 from escaping through the walls of the bag 14. The materials from which the inner liner and the outer shell 14*a* are made are selected to resist degradation due to the nature of the commodities that may be placed in the bags 14. The neck 18 of the inner liner may be of any useful shape or size and is typically sized to permit fast filling of the bag 14. The bag support loops 18*a* are typically utilized to support the bulk bag 14 during filling, with the bag being placed on a pallet P for movement, storage, and shipment after the bag 14 has been filled.

2. Representative Prior Art

Bag filling machines of the prior art as exemplified by U.S. Pat. Nos. 4,676,284 and 5,036,983, have been drawn to the problem of hanging a bag 14 from a number of bag hanging hooks 18*a* and have neglected the problem of closing the neck 18 of the bags 14 to seal up the contents of the bag 14. In general, the closing of the tops or necks 18 of filled bulk bags 14 has been a manual operation requiring an operator of a bulk bag filling machine to close or seal the top of the inner liner of a bulk bag by hand using twist ties or other suitable closures. This practice is not only time consuming and strenuous for an operator of a bulk bag filling machine, but the operator may also be exposed to the contents of the bulk bag being filled.

OBJECTIVES OF THE INVENTION

Accordingly, it is an objective of the present invention to provide a bulk bag filling machine that is capable of filling, sealing, and releasing a bulk bag without direct operator intervention. Another objective of this invention is to provide a bag filling spout which is not only capable of sealing the top of a bulk bag, but which is also capable of removing fill material from the exterior of the sealed top of the bulk bag. And, in the interests of making the hanging of a bulk bag beneath a bag filling spout quicker and easier for an operator, it is yet another object of this invention to provide moveable bag hanging hooks.

SUMMARY OF THE INVENTION

In order to overcome the limitations present in prior art bag filling machines, and to meet the objectives also set forth above, a bulk bag filling machine comprising a supply hopper having a material flow control mechanism connected to its outlet for controlling the flow of material from the hopper and a rotatable bag filling spout constructed and arranged for rotation about a vertical axis. The rotatable bag filling spout is connected to the material flow control mechanism to conduct material from the supply hopper to a bag that is to be filled.

The bulk bag filling machine further comprises a bag hanging mechanism for hanging bags that are to be filled beneath the bag filling spout and a bag sealing mechanism that is operable in conjunction with the rotatable bag spout to seal a top of a bag that has been rotated closed by the bag spout.

The bag filling spout is more specifically comprised of a vertically oriented fill tube that has an upper end and a lower end with the upper end of the fill tube being connected to the material flow control mechanism so as to receive and conduct material that is to be placed in a bag. The material is received into the upper end of the fill tube from the material flow control mechanism and discharged from the lower end of the fill tube into the bag. A blower manifold is positioned adjacent the upper end of the fill tube and has attached thereto a blower for creating air flow through the manifold. An outer tube having an upper end and a lower end is received over the vertically oriented fill tube in coaxial relation with the fill tube. An air space is thereby formed between the fill tube and the outer tube. The upper end of the outer tube extends into the blower manifold such that the air space is in fluidic communication with the blower manifold. The lower end of the outer tube is arranged to have secured thereto the mouth of a bag such that the air space and the fill tube are in communication with the interior of the bag. A support collar affixed to the upper end of the outer tube permits the outer tube to rotate independent of the fill tube and a rotary actuation mechanism is provided to rotate the outer tube in this manner.

More than one blower may be attached to the blower manifold. However, a single blower may be sufficient so long as it is capable of causing two way air flow through the manifold and hence, the air space.

DETAILED DESCRIPTION OF THE INVENTION

Figure 1:
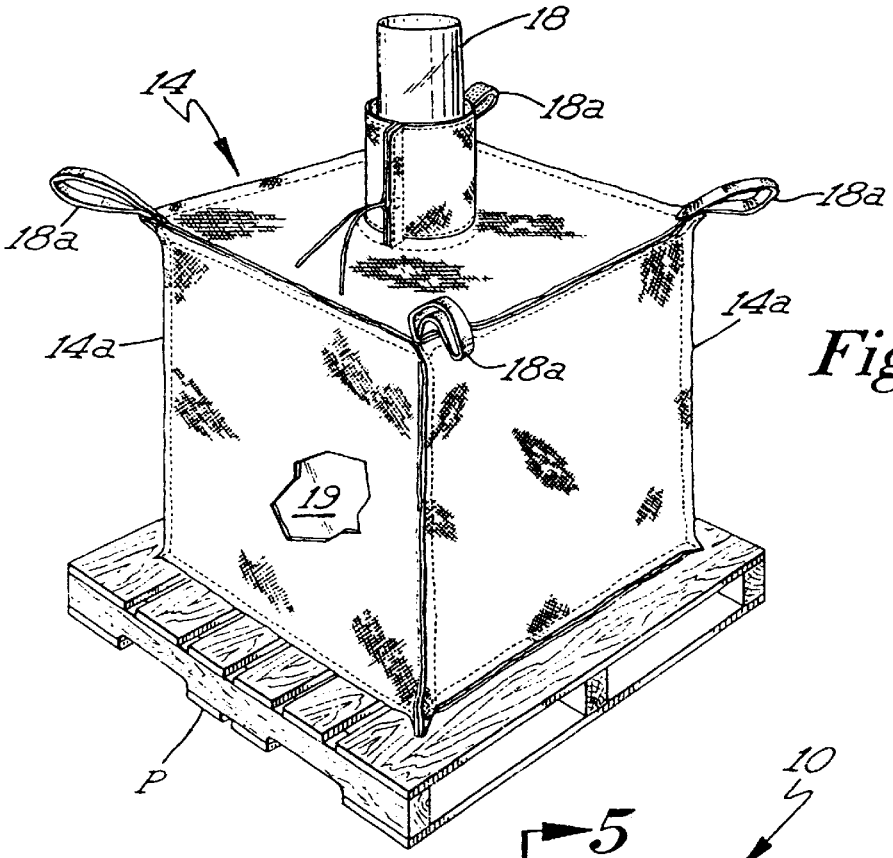
FIG. 1 is perspective view of a typical bulk bag of the prior art.

These and other objectives and advantages of the invention will appear more fully from the following description, made in conjunction with the accompanying drawings wherein like reference characters refer to the same or similar parts throughout the several views. And, although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 2:
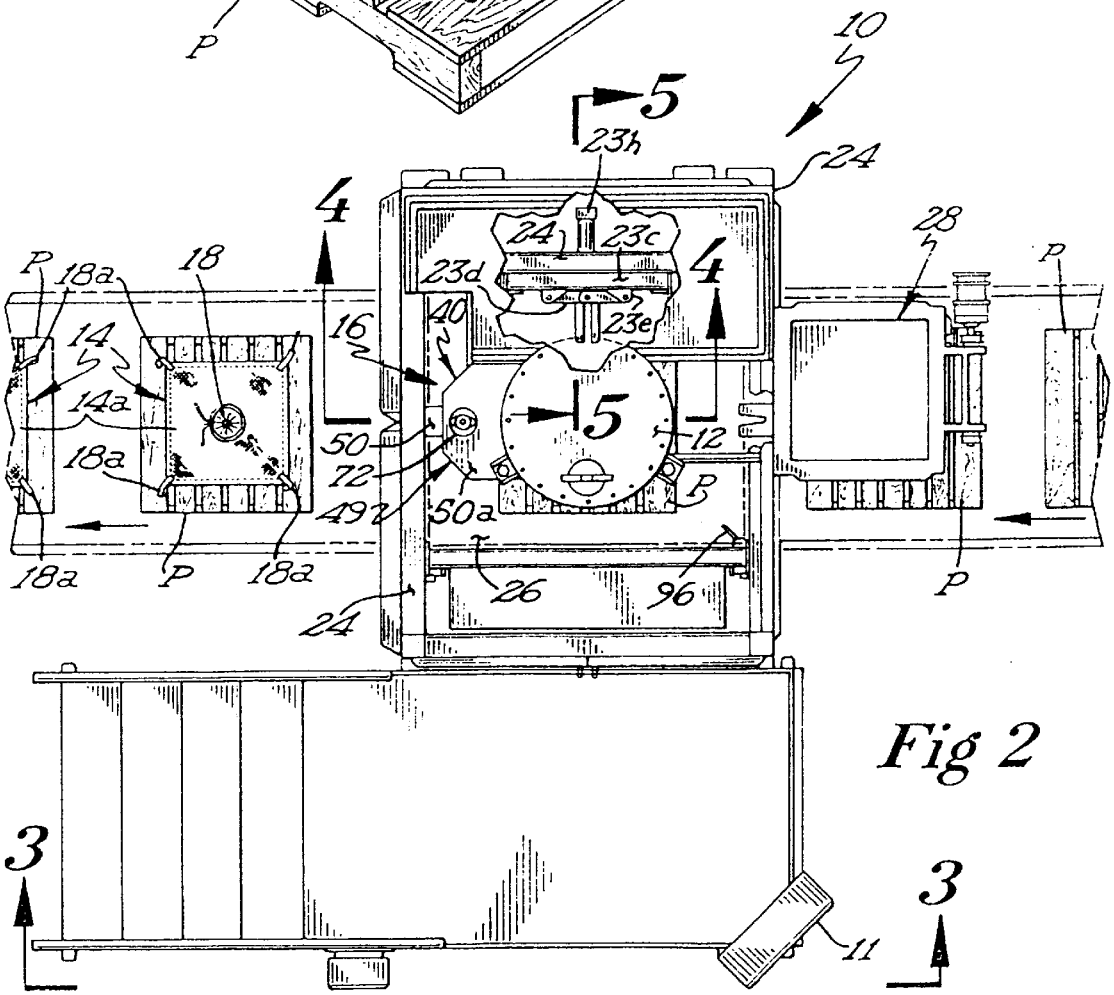
FIG. 2 is a top plan view of a bulk bagging machine.
Figure 3:
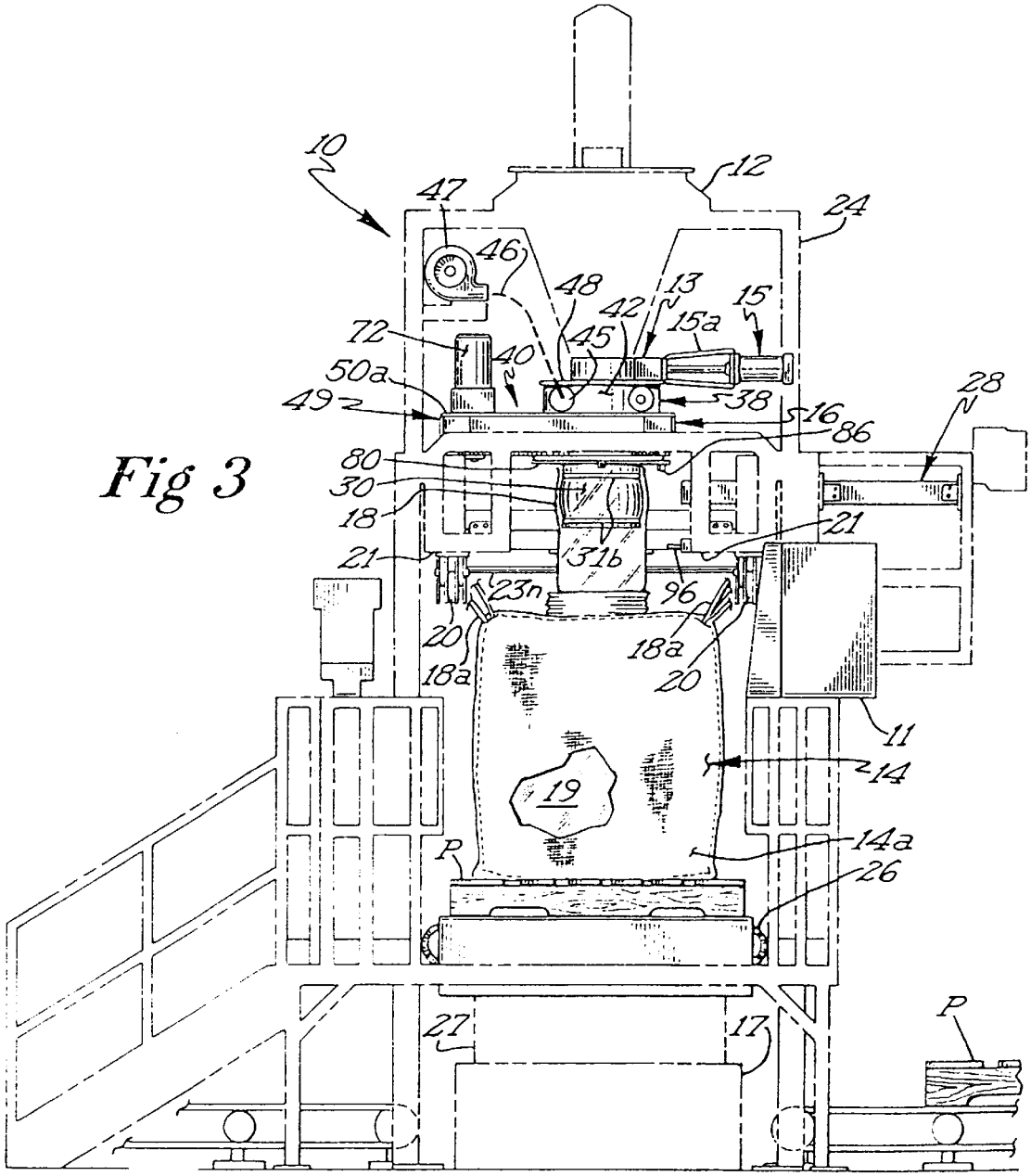
FIG. 3 is a front elevational view of a bulk bagging machine as taken along view lines 3—3 in FIG. 2 and showing a bulk bag being filled in the bulk bag filling machine.

FIGS. 2–3 illustrate a bulk bag filling machine 10 of the present invention. The bulk bag filling machine 10 generally comprises a supply hopper 12 for storage and supply of the materials which are to be placed in a bulk bag 14. The supply hopper 12 is connected to a rotating spout assembly 16 for directing material into a bulk bag 14 and for twisting shut the neck 18 of a filled bulk bag 14. A structure for hanging a bulk bag 14 beneath the rotating spout assembly 16 preferably comprises respective pairs of front and rear bag hanging hooks 20, 22. The respective pairs of bag hanging hooks 20, 22 of the preferred embodiment are arranged and constructed to support an equal number of hook engaging members or bag support loops 18*a*. It must be understood that the exact number and arrangement of bag hanging hooks may be varied to accommodate the filling of variously arranged bulk bags without exceeding the scope of the appended claims.

A sealing mechanism 28 operates in conjunction with the rotating spout assembly 16 to close the neck 18 of a liner of the bulk bags 14. A filled bulk bag 14 is typically placed on a pallet P which is supported on a motorized conveyor located directly beneath the rotating spout assembly 16. In the preferred embodiment of the present invention the motorized conveyor 26 is mounted on a lift 27, which may be of the scissors lift type. The lift 27 is capable of supporting a filled bulk bag 14 on a pallet P at various heights above the floor upon which the bulk bag filling machine 10 rests. This is useful where bulk bags 14 of varying sizes need by filled. The lift 27, in addition to supporting a bulk bag 14 on a pallet P, is supported on a weighing mechanism 17 for monitoring the gross weight of a bulk bag and its contents. The weighing mechanism 17 typically comprises a plurality of load cells (not shown) upon which the lift 27 rests. A generally rectangular framework 24 is provided to support the supply hopper 12, rotating spout assembly 16, bag hanging mechanism, and associated components. A servomechanism 11 is also provided to coordinate the activities of the various components of the bulk bag filling machine 10 so as to rapidly and reliably fill bulk bags 14. A suitable servomechanism 11 may comprise a computer that is electrically connected to the various components of the bag filling machine 10 so as to control the activation of those components.

In general, the operation of the bulk bag filling machine 10 is as follows: A bulk bag 14 is suspended on front and rear bag hanging hooks 20 and 22 beneath the rotating spout assembly 16. The neck 18 of a plastic liner 19 of the bulk bag 14 is placed over the lower most end of the spout 16. An inflatable cuff or bladder 30 is inflated to hold the neck 18 of the bulk bag liner 19 on the rotating spout assembly 16. The empty bulk bag 14 is then inflated by the spout assembly 16 and the gate valve 13 is opened to allow material to pass from the supply hopper 12 and into the bulk bag 14. During filling, the bag hanging hooks 20, 22 are released to allow all of the weight of the bulk bag 14 to be supported on the pallet P resting on the conveyor 26, thus facilitating the weighing of the bulk bag 14 and its contents. When the weighing mechanism 17 upon which the conveyor 26 rests senses that a desired charge of material has been placed in the bulk bag 14, the gate valve 13 closes to shut off the flow of material into the bulk bag 14 and the spout assembly 16 rotates to twist the neck 18 of the bulk bag 14 closed. A sealing mechanism 28 then moves in to close the twisted neck 18 of the bulk bag 14. The sealed bulk bag neck 18 is released from the spout assembly 16 and the conveyor 26 then moves the filled bag 14 out of the bulk bag filling machine 10 and the process is repeated.

As seen in FIGS. 2 and 3, the bulk bag filling machine 10 of the present invention has a supply hopper 12 mounted directly above the rotating spout assembly 16. This arrangement allows materials stored in the supply hopper 12 to flow through the spout assembly 16 by means of gravity alone. However, where so desired, as when there are severe space limitations placed on a bulk bagging machine 10, a supply hopper 12 such as that illustrated in FIGS. 2 and 3 may be omitted in favor of an auger feed mechanism such as that disclosed in U.S. Pat. No. 5,109,894 to Harold McGregor, the specification of which is hereby incorporated by reference. Valve mechanism 13, which is in this preferred embodiment a gate valve, is controlled by the servomechanism to meter the flow of the material from the supply hopper 12. For example, because bulk bags 14 are large, it is preferred to maximize the filling rate of the material into a bulk bag 14 at the outset of the filling cycle. As a bulk bag 14 nears it target weight, the valve mechanism 13 reduces the flow rate of the material from the supply hopper 12 into the bulk bag 14. Material from the supply hopper is allowed to pass into the bulk bag 14 at a very slow rate, thereby approaching the target charge weight of the bulk bag 14 in a more controlled manner. When the bulk bag 14 reaches its target charge weight, the gate mechanism 13 is able to quickly stop the flow of material from the supply hopper 14. The gate mechanism 13 is typically actuated by a fluidic motor 15, which is in the preferred embodiment a reverseable double acting power cylinder. A piston 15A of the fluidic motor 15 is secured to the valve mechanism 13 in such a manner as to control the flow of material from the supply hopper 12.

Figure 4:
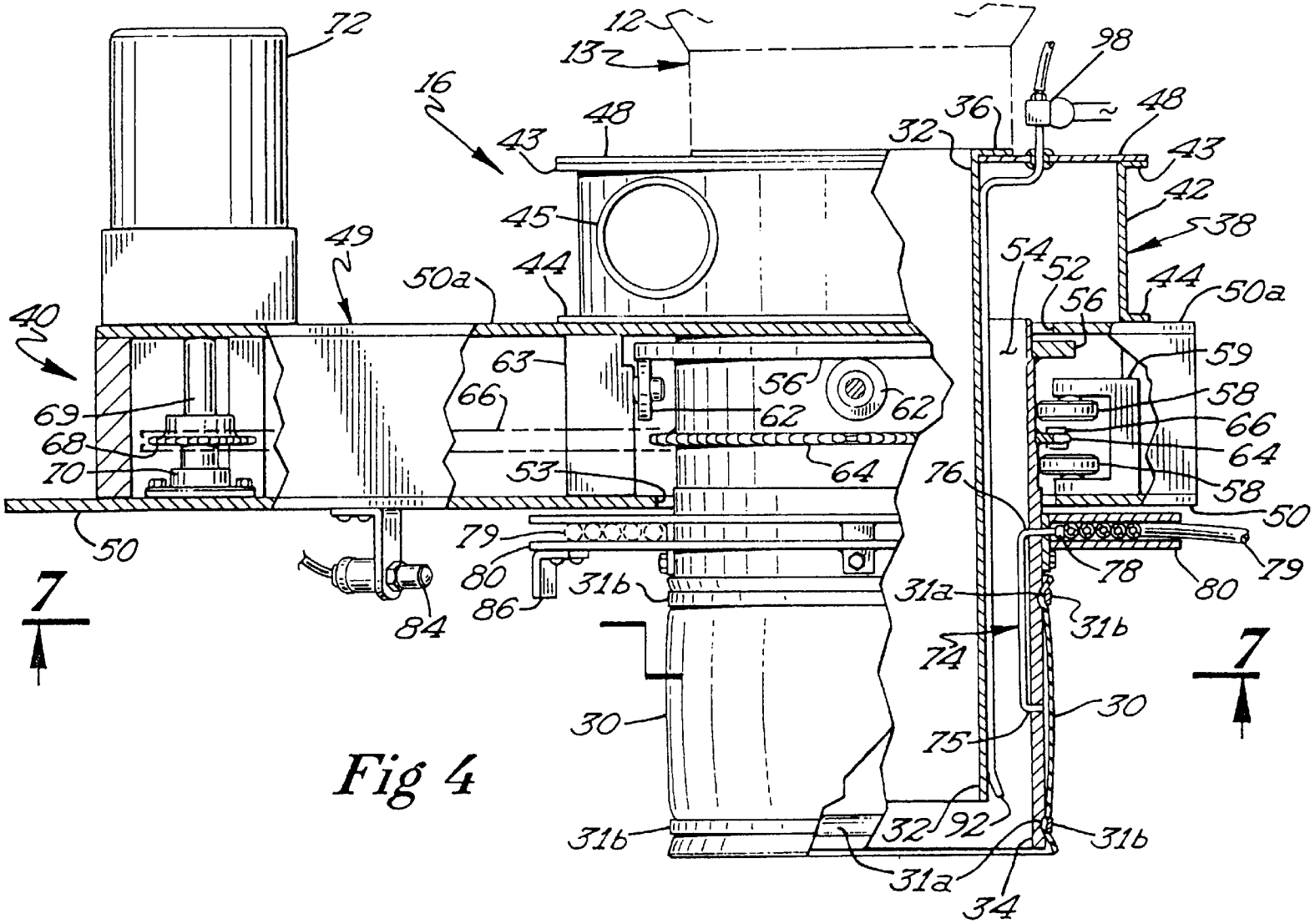
FIG. 4 is a partially cut-away side elevational detail view of the rotating spout assembly of the present invention taken along cutting lines 4—4 of FIG. 2.
Figure 7:
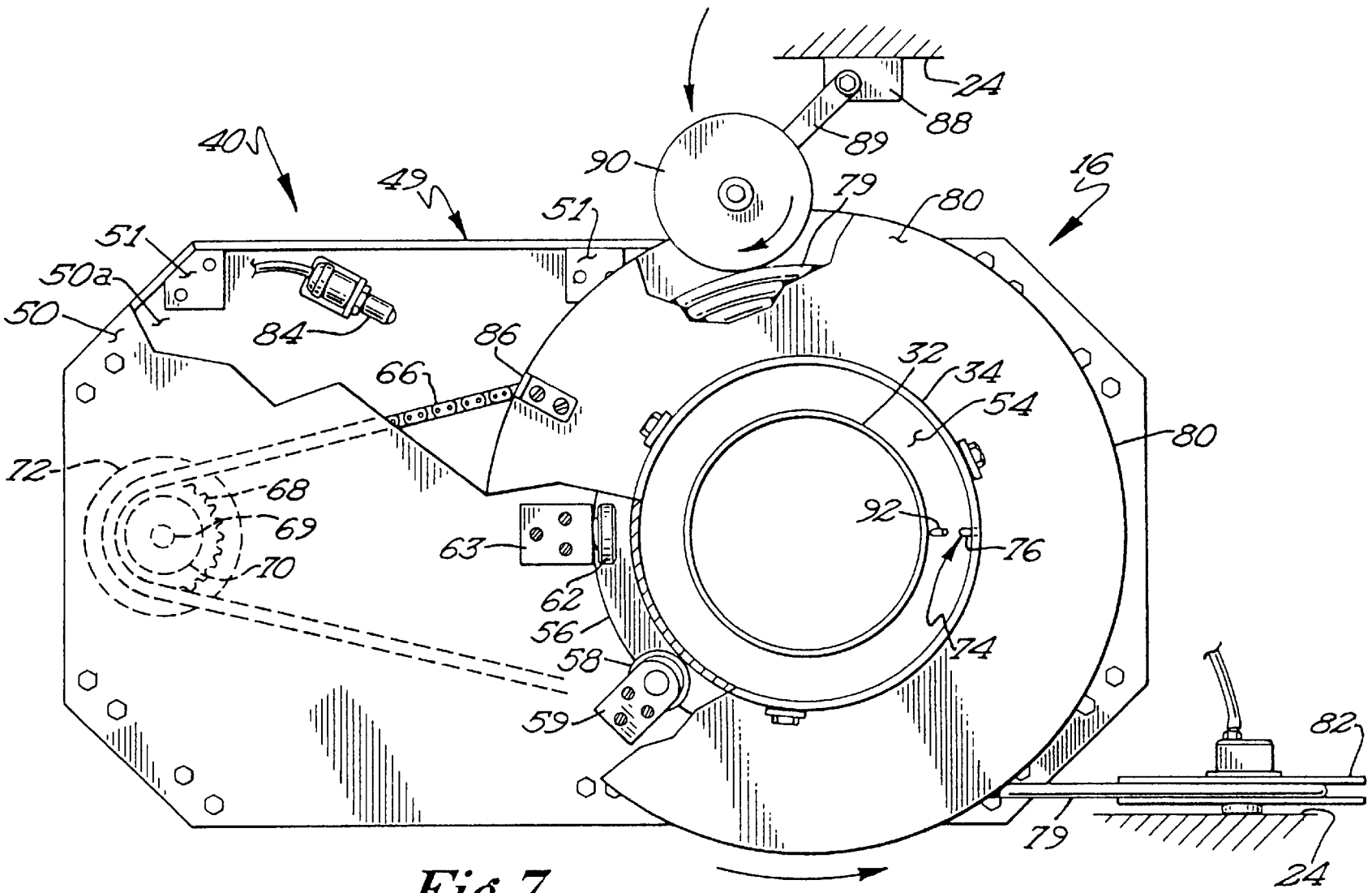
FIG. 7 is a partially cut away bottom detail view of the rotating spout assembly taken along cutting lines 7—7 of FIG. 4.
Figures 8, 9, 10:
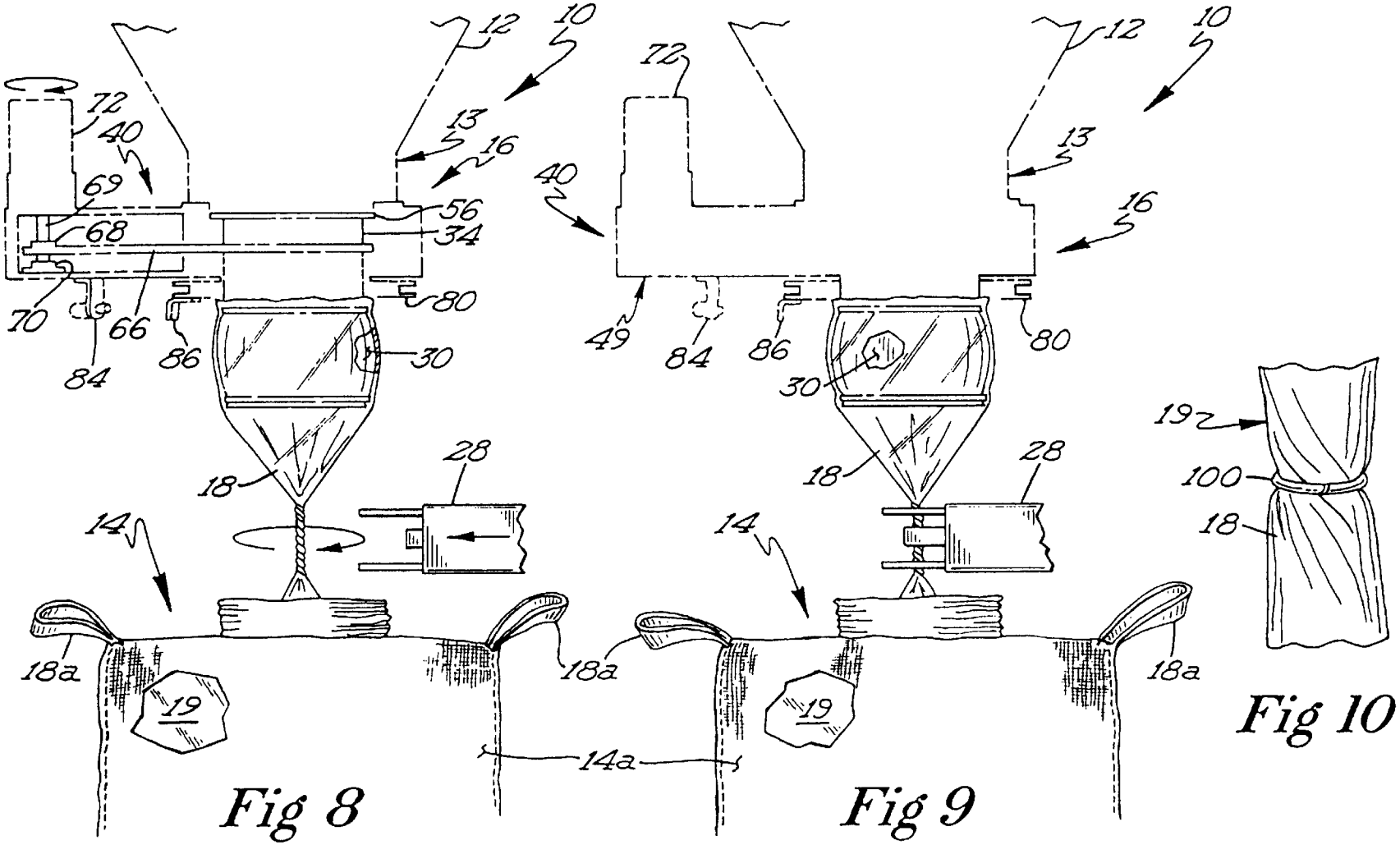
FIG. 8 illustrates the neck of the liner of a bulk bag being twisted closed by the rotating spout assembly.
FIG. 9 illustrates the bag sealing mechanism extending to seal the liner of the bulk bag closed.
FIG. 10 is a close up of a closure mechanism of the type preferably used to seal the liner of a bulk bag.

FIGS. 4 and 7 illustrate the rotating spout assembly 16. The rotating spout assembly 16 is comprised of two concentric tubes, an inner fill tube 32 and an outer air tube 34. The outer air tube 34 has secured there around at its lower end an inflatable cuff or bladder 30. The outer air tube 34 is sized so that the neck 18 of a liner of bulk bag 14 may be placed thereover. The cuff 30 is essentially a section of an elastomeric tube sealed at its upper and lower ends to the exterior surface of the outer fill tube 34. An airspace is thereby created between the inner surface of the cuff 30 and the outer surface of the lower end of the fill tube 34. When pressurized air is injected into the airspace formed by the cuff 30, the cuff is inflated and may secure the neck 18 of the bulk bag liner to the rotating spout assembly 16 in an airtight manner as illustrated in FIGS. 3, 8–9.

Referring specifically to FIG. 4, the structure of the rotating spout assembly 16 may be seen. The inner fill tube 32 is secured at its upper end as by welding to a flange 36. Flange 36 is in turn secured to valve mechanism 13 shown in FIG. 3. The fill tube 32 extends downward through a blower manifold 38 which is supported upon a spout support structure 40. The blower manifold 38 in this embodiment comprises a generally cylindrical sidewall 42 having upper and lower flanges 43 and 44, respectfully. The sidewall 42 of the manifold 38 will have formed therethrough at least one blower inlet 45. However, the sidewall 42 of the blower manifold 38 may have formed therethrough as many as four blower inlets 45. The blower inlets 45 are connected through ducting 46 to on or more blowers 47 (FIG. 3). Blowers 47 act to create positive or negative air pressure and flow within and through the blower manifold 38. The ducting 46, as illustrated in FIG. 3, may be either flexible or rigid depending on the needs of a particular application. In order to contain and channel the negative and positive air pressures created within the blower manifold 38, an annular plate 48 having a hole therethrough to receive the fill tube 32 is secured to the upper flange 43 of the sidewall 42 of the blower manifold 38. The sidewall 42 of the blower manifold is secured by lower flange 44 to an upper surface of the spout support structure 40 defined by top plate 50*a*.

The spout support structure 40 has a substantially rigid body 49 defined by top plate 50*a* and bottom plate 50. The top and bottom plates 50*a*, 50 are held in rigid parallel relation with one another by spacer blocks 51 located at the corners of the top and bottom plates 50*a*, 50. The spacer blocks 51 are secured to the top and bottom plates 50*a*, 50 using machine screws, however, other means of connection including bolts or welding may be utilized. Fill tube 32 passes through a pair of vertically aligned apertures 52, 53 formed through the top plate 50*a* and the bottom 50 of the spout support structure 40 respectively. Generally, the fill tube 32 will be concentrically aligned with apertures 52, 53.

The outer air tube 34 is received over the lower end of the fill tube 32 and has an upper end that extends through aperture 52 and into blower manifold 38. Fill tube 32 and air tube 34 are sized so as to create an annular space 54 therebetween along substantially the entire length of the respective tubes 32, 34. This annular space 54 is open at its top end to the interior of the blower manifold 38 and subsequently there is fluidic communication between the blower manifold 38 and the annular space 54 down to its lower end at the tip of the rotating spout assembly 16.

The air tube 34 is supported concentrically with the inner fill tube 32 by a support collar 56 which is affixed to the outer surface of the air tube 34. The support collar 56 is located between the top plate 50*a* and bottom plate 50 of the spout support structure 40 and comprises a flat annular ring affixed to the outer surface of the air tube 34 adjacent the top plate 48. A plurality of vertical support bearings 62 are arranged around the circumference of the air tube 34 between the top and bottom plates 50*a*, 50. The vertical support bearing mounts 63 preferably contact, and are secured to, opposing inner surfaces of the top and bottom plates 50*a*, 50. The vertical support bearings 62 disposed around the air tube 34 contact a lower surface of the support collar 56, thereby supporting the air tube 34. The air tube 34 is freely rotatable upon vertical support bearings 62. At least three vertical support bearings 62 are required to properly support the air tube 34 within the spout support structure 40, though four or more such bearings 62 may also be utilized.

In order to insure that the air tube 34 remains concentric with the fill tube 32, a plurality of horizontal support bearings 58 are also provided. The horizontal support bearings 58 contact the outer surface of the air tube 34 in such a manner as to maintain the concentric relationship between the air tube 34 and the fill tube 32. At a minimum, three horizontal support bearings 58 evenly spaced around the circumference of the air tube 34 are sufficient to maintain the concentric relationship between the fill tube 32 and the air tube 34. However, four or more horizontal support bearings may be utilized to maintain the concentric relationship between the tube 32, 34. In the preferred embodiment of the spout support structure 40, pairs of horizontal support bearings 58 are mounted in a single, U-shaped horizontal support bearing mounts 59. In this manner, each pair of horizontal support bearings of each bearing mount 59 are able to bracket a chain ring 64 that is secured around the outer surface of the air tube 34 as illustrated in FIG. 4. The combination of vertical support bearings 62 and horizontal support bearings 58 solidly support the air tube 34 independent from the fill tube 32 and in addition, permit the air tube 34 to be rotated independent from the fill tube 32.

In order rotate air tube 34, a chain or toothed belt 66 is wrapped about chain ring 64 and a drive sprocket 68 rotatably mounted on a shaft 69 which is in turn rotatably mounted in bearing block 70. Shaft 69 is connected to and powered by a motor 72 mounted to the top plate 50*a* of the spout support structure 40. It is to be understood that structures other than the preferred embodiment for rotating the air tube 34 may be used without exceeding from the broad scope of the claims appended hereto. By way of example only, suitable actuation mechanisms for rotating the air tube 34 may include toothed belts used in conjunction with complementary timing wheel type sprockets, direct drive from the mother utilizing a worm gear arrangement or standard gear sprockets arranged in direct driving contact with one another.

Furthermore, it must be understood that where there is no need to inflate a bag 14 that is being filled, or where it is impracticable or undesirable to include a blower and blower manifold with a bag filling machine 10, it may be desirable to provide the bag filling machine with only the outer tube 34. Insofar as the inner tube 32 may be shortened and used only as a means to funnel commodities from the supply hopper into the rotatable outer tube 34, the bulk bag filling machine may adequately fill and seal bulk bags using only an outer tube 34.

As can best be seen in FIG. 4, the inflatable cuff or bladder 30 is received around the lower end of the air tube 34. Circumferential grooves 31A are provided in the air tube 34 at upper and lower sealing locations for the cuff 30. Sealing bands 31B are secured around an upper edge and a lower edge of the cuff 30 at the respective sealing grooves 31A, thereby creating an air tight cavity between the cuff 30 and the outer surface of the air tube 34. Pressurized air is introduced into the cavity formed between the exterior of the air tube 34 and the cuff 30 by nipple 74. The first end 75 of the nipple 74 is inserted through the wall of the air tube 34 from the interior of the air tube. The second end 76 of the nipple 74 extends along the inner surface of the air tube 34 to a position above the sealing groove 31A where it extends through the wall of the air tube 34. An airline connection 78 is made to an airline 79 which is in part coiled upon spout hose reel 80. The spout hose reel 80 is affixed to the outer surface of the air tube 34 and rotates with the air tube 34. The airline 79 extends from the spout hose reel 80 to a frame mounted hose reel 82 best seen in FIG. 7. The frame mounted hose reel 82 is spring loaded to maintain constant tension on the airline 79. The frame mounted hose reel 82 also provides a connection to a pressurized air source in a well-known manner.

A rotation sensor for controlling the rotation of the air spout 34 is best seen in FIGS. 4 and 7. The rotation sensor of the present invention comprises a proximity sensor 84 and an angular position sensor 88. The proximity sensor 84 is utilized to count the number of rotations of the outer air tube 34. As the air tube 34 rotates, a flag 86 affixed to the lower surface of the spout hose reel 80 passes in front of the proximity sensor 84. Each time the flag 86 passes in front the proximity sensor 84, the sensor 84 sends a signal to the servomechanism 11 which controls the rotation of the air tube 34. In order to determine the amount of airline 79 coiled upon the spout hose reel 80, an angular position sensor 88 having a lever arm 89 upon which is mounted a roller 90 is fixed to the framework 24 of the bulk bag filling machine 10 in alignment with the airline 79 coiled upon the spout hose reel 80. The lever arm 89 of the angular position sensor 88 is spring loaded so as to bias the roller 90 into contact with the airline 79 coiled upon the spout hose reel 80. By calibrating the annular position sensor 88 with regard to the diameter of the airline 79 coiled upon the spout hose reel 80, the angular position sensor 89 may be utilized to sense the number of turns of airline 79 coiled about the spout hose reel 80.

Figure 5:
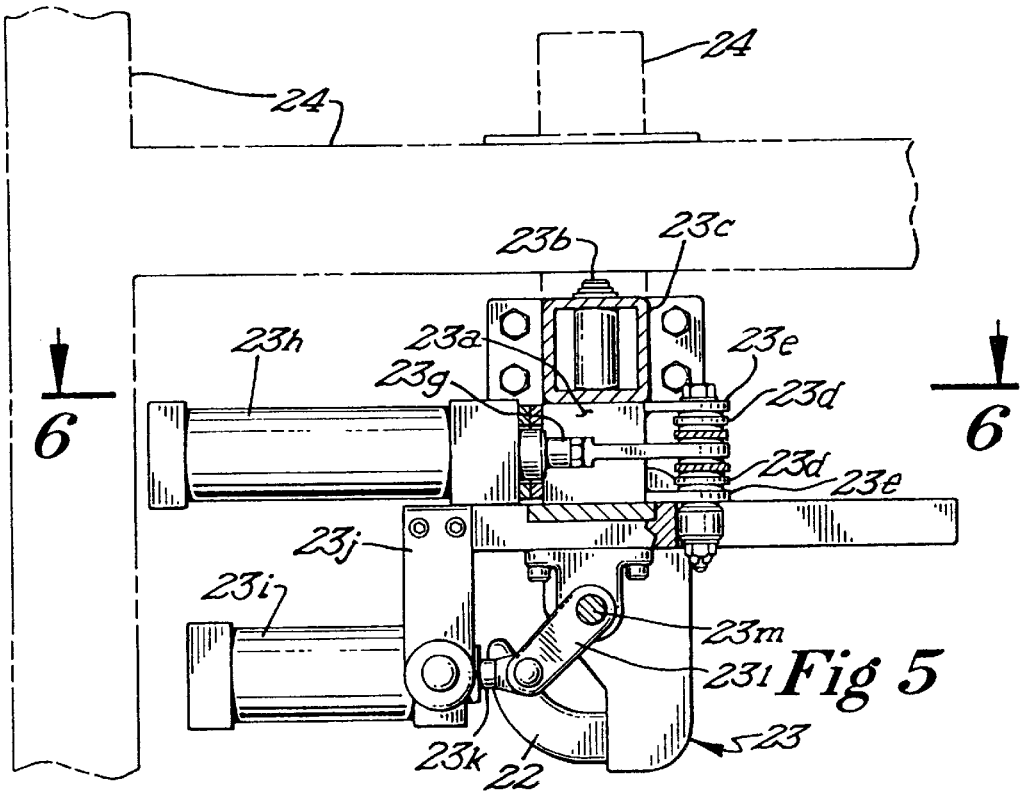
FIG. 5 is a cut away side view of a rear bag hanging hook taken along cutting lines 5—5 of FIG. 2.
Figure 6:
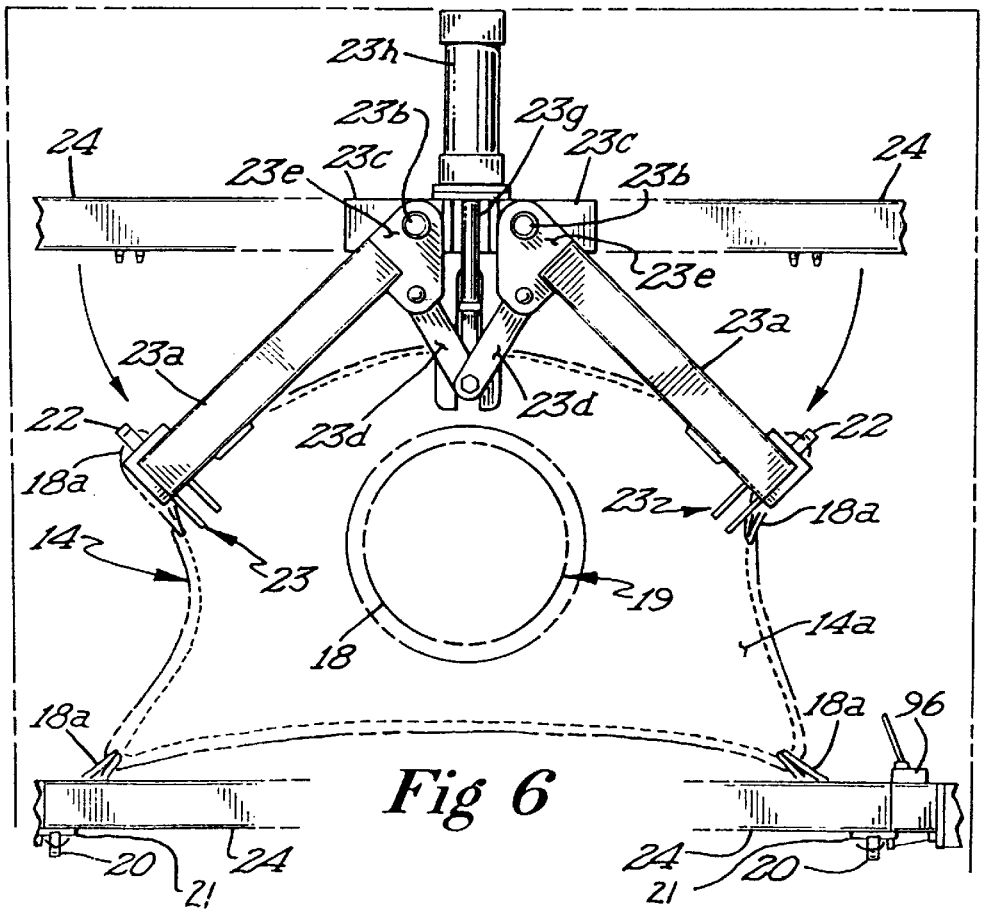
FIG. 6 is a partial top view of the front and rear bag hanging hooks as taken along cutting lines 6—6 of FIG. 5.

As best seen in FIGS. 5–6, the front and rear bag hanging hooks 20, 22 are arranged somewhat beneath the lower end of the rotating spout assembly 16 so as to center a substantially square bulk bag 14 under the rotating spout assembly 16. The front pair of bag hanging hooks 20 are fixed in their location relative to the rotating spout assembly 16. The front bag hanging hooks 20 themselves are rotatable between an upper bag hanging position in which hooks are maintained at approximately 90 degrees to the front bag hanging hook supports 21 and a second lower, bag release position in which the hooks 20 are angled nearer to 180 degrees to the front bag hanging hook supports 21.

The rear bag hanging hooks 22 are movable with respect to the rotating spout assembly 16. Each of the rear bag hanging hooks 22 is supported on a bag hanging support 23. Each of the bag hanging supports 23 is in turn mounted on respective cantilevered hook arms 23*a* which are themselves rotatably mounted by pinpoints 23*b* to sub-frame assembly 23*c*. The sub-frame assembly 23*c* is secured to the framework 24 of the bulk bag filling machine 10. A linkage 23*d* comprising a plurality of lever arms 23*e* is rotatably pinned to projections 23*d* on each of the cantilevered hook arms 23*a*. The linkage 23*d* has connected thereto piston 23*g* of double acting power cylinder 23*h*. The power cylinder 23*h* is secured to the sub-frame assembly 23*c* such that when its piston 23*g* is extended, linkage 23*d* acts to rotate the projections 23*e* of each of the cantilevered hook arms 23*a* toward the rotating spout assembly 16 to their bag hanging positions as illustrated in FIG. 6. Conversely, when the piston 23*g* of the power cylinder 23*h* is retracted, the cantilevered hook arms 23*a* are rotated away from the rotating spout assembly 16 to their bag filling and release positions in which the cantilevered hook arms 23*a* are substantially parallel with the sub-frame assembly 23*c*.

The rear bag hooks 22 are themselves rotated between their bag hanging and bag release positions by cylinder 23*i* (FIG. 5). Cylinder 23*i* is mounted on bracket 23*j* which is in turn secured to the sub-frame assembly 23*c*. The piston 23*k* of the cylinder 23*i* is connected through a crank arm 23*l* to shafts 23*m* (FIG. 3). The shafts 23*m* extend laterally through the universal joints to the respective bag hanging supports 23 where they mate with the rear bag hanging hooks 22. When the piston 23*k* of the cylinder 23*i* is extended, crank arm 23*l* rotate shafts 23*m* so as to rotate the bag hanging hooks 22 downward to their bag release positions. Conversely, retraction of the piston 23*k* rotates the bag hanging hooks 22 to their upper bag hanging and filling positions.

The front bag hanging hooks 20 are rotated between their upper bag hanging positions and lower bag release position in substantially the same manner as are the rear bag hanging hooks 22. However, as the front bag hanging hooks 20 are stationary with respect to the rotating spout assembly 16, a single shaft 23*n* may be utilized to rotated the front bag hanging hooks 20. Nor is a universal joint required between the shaft 23*n* and the piston of a cylinder (not shown).

Operation of Bulk Bag Filling Machine

At the beginning of the bulk bag filling process, the servomechanism 11 which coordinates the various components of the bulk bag filling machine 10 in the filling of bulk bag 14 initiates a reset process whereby the relative home and ready positions of the air tube 34 of the rotating spout assembly 16 are determined. In its normal ready position, spout hose reel 80 has a plurality of turns of the airline 79 wound thereabout. Preferably there are between 10 and 12 turns of airline 79 wound about the spout hose reel 80 when it is in its ready position. Conversely, in its home position, air tube 34 has no turns of airline 79 wound about the spout hose reel 80. Utilizing the proximity sensor 84 and the angular position sensor 88, the servomechanism which operates the bulk bag filling machine 10 is capable of accurately determining both the home and ready positions for the rotating spout assembly 16.

In its reset mode, the servomechanism actuates the motor 72 to rotate the air tube 34 in a direction so as to unwind airline 79 from spout hose reel 80. Because the frame hose reel 82, upon which airline 79 is also wound is spring loaded, the length of airline 79 which is unwound from the spout hose reel 80 is wound up upon frame mounted hose reel 82 so as to keep the airline 79 taut between the two hose reels 80, 82. As the airline 79 is unwound from the spout hose reel 80, the roller 90 of the angular position sensor 88, which is in constant contact with the outer turn of the airline 79 wound up on spout hose reel 80, moves inwardly toward the exterior surface of air tube 34. When the roller 90 reaches a predetermined location with relation to the exterior surface air tube 34, the servomechanism reverses the rotation of motor 72 so as to cause the air tube 34 of the rotating spout assembly 16 to rotate in the opposite direction, and thereby winding turns of airline 79 onto the spout hose reel 80. During this re-winding, the servomechanism 11 counts the number of turns of airline 79 wound upon the spout hose reel 80 by counting the number of times that the flag 86 passes in front of the proximity sensor 84. When the air tube 34 has been rotated through a predetermined number of turns, the motor 72 is deactivated and the air tube 34 of the rotating spout assembly 16 in its ready position and the bulk bag filling machine 10 is then ready to begin filling bulk bags 14. The reset mode for determining the relative home and ready positions of the outer air tube 34 is typically utilized after any interruption in the supply of electricity to the servomechanism.

With the rotating spout assembly 16 in its ready position, an operator of the bulk bag filling machine 10 activates the servomechanism 11 which causes the front and rear bag hanging hooks 20, 22 to rotate to their upper bag hanging and filling positions. Simultaneously, power cylinder 23*b* is activated to rotate the cantilever bag hanging supports 23*a* to their forward bag hanging position. The operator then enters the bulk bag filling machine 10 with a bulk bag 14 and hangs the bulk bag 14 by the bag hanging loops 18*a* from the bag hanging hooks 20, 22. With the bulk bag 14 being suspended from the bag hanging hooks 20, 22, the neck 18 of the liner of the bulk bag 14 is positioned substantially beneath the concentric fill and air tubes 32, 34 of the rotating spout assembly 16.

Next, the operator places the neck of the liner over the exterior of the air tube 34, being careful to ensure that the neck 18 of the bulk bag 14 extends above the inflatable cuff 30 attached to the air tube 34. The operator activates a switch 96 (FIG. 6) secured to the framework 24 which indicates to the servomechanism 11 that the cuff 30 should be inflated. The servomechanism then opens a solenoid valve (not shown) to allow pressurized air to pass through airline 79 and nipple 74 to inflate the cuff 30. The elastomeric material from which the cuff 30 is made expands into contact with the inner surface of neck 18 of the liner of the bulk bag 14, thereby creating an air tight friction fit between the interior of the neck 18 and the cuff 30. See FIGS. 3, 8–9. The operator exits the bulk bag machine 10 and again activates the servomechanism 11 so as to begin the next step in the bag filling process.

Once the operator has exited the bag filling machine 10, the servomechanism again activates the power cylinder 23*b* to rotate the cantilever bag hanging supports 23 to their rearward bag filling positions. Simultaneously, the servomechanism activates a blower 47 which creates a positive air pressure within the blower manifold 38 and a positive air flow through the annular space formed between the air tube 34 and the fill tube 32 into interior of the liner 19 of the bulk bag 14, thereby inflating the empty bulk bag. Once the bag 14 has begun to inflate, the valve mechanism 13 opens to allow material stored in the supply hopper 12 to pass into the bulk bag 14 through the fill tube 32. While the bulk bag is filling, the blower 47 or blowers 47 begin a cycle of positive and negative and airflow into the interior of the bulk bag 14. The positive to negative cycle of air flowing into and out of the interior of the bulk bag aids in the settling of the material being placed in the bulk bag 14 and helps to remove folds or wrinkles in the liner of the bulk bag which might otherwise cause a failure in the liner of a filled bulk bag 14. As the material to be placed inside the bulk bag first begins to flow, the bulk bag is substantially suspended from the bag hanging loops 18A which have been placed over the front and rear bag hanging hooks 20, 22. At this initial stage of the fill process, the weight of the material filling the bulk bag 14 helps to fully unfold the sides of the bulk bag, thereby removing any wrinkles or folds that might exist in the liner of the bulk bag 14. When the liner of the bulk bag has been filled to approximately ¼ of its volume, the motorized conveyor 26 supported on the lift 27 begins to move upward so that pallet P may support the entire weight of the bulk bag 14.

Preferably, the lift 27 is mounted upon a weighing mechanism 17 (preferably load cells) which permits the servomechanism to monitor the total weight of the bulk bag 14. As the bulk bag 14 approaches its target charge weight, the valve mechanism 13 begins to close, thereby slowing the rate at which material from the supply hopper 12 may pass into the bulk bag 14. The filling of the bulk bag 14 at these lower material flow rates is called the dribble mode, as the valve mechanism 13 will allow the material in the supply hopper 12 to dribble into the bulk bag 14 until the load cells 17 of the lift 27 indicate that the target charge weight of the bulk bag has been reached. When the target charge weight has been reached, the servomechanism actuates the valve mechanism 13 to close off the flow of material from the supply hopper 12. During the dribble mode, the servomechanism causes the front and rear bag hanging hooks 20, 22 to be rotated to their lower bag release positions, thereby transferring the entire weight of the bulk bag 14, the pallet P upon which it rests, and the contents of the bulk bag 14 to the load cells upon which lift 27 are mounted. In this manner, the servomechanism 11 is able to monitor the quantity of material which has been placed in the bulk bag.

When the dribble mode ends, the blower or blowers 47 are operated so as to draw air from the head space of the filled bulk bag 14 through the annular space between the outer air tube 34 and the inner fill tube 32 and into the blower manifold 38. The negative air flow has the effect of removing air and fluidized fill material suspended in the air of the head space of the bulk bag 14. The negative air flow also reduces the volume of the head space of the bulk bag 14. At this point, motor 72 is actuated to rotate the air tube 34 so as to unwind the airline 79 from the spout hose reel 80. The rotation of the air tube 34 twists the neck 18 of the bulk bag 14 closed. When the air tube 30 has been rotated a predetermined number of times as monitored by the proximity senor 84 as described above, the bag sealing and closing mechanism 100 moves in from its resting position to engage the twisted portion of the neck 18 of the liner of the bulk bag 14. As the bag sealing and closing mechanism 28 moves towards the neck 18 of the bulk bag 14, the neck 18 may still be rotating with the air tube 34. At this same time, the servomechanism actuates solenoid valve 94 to open the airjet nozzle 92. The pressurized air passing from the nozzle 92 causes any of the material that has been placed in the bulk bag 14 which may be present on the interior of the neck 18 of the bulk bag above the point where the neck has been twisted close, to be fluidized, that is to be blown from the sides of the interior of the neck and suspended in the air within the neck 18. The fluidized material dislodged by the air nozzle 92 is withdrawn from the neck 18 by the negative air flow created by the blowers 47 acting through the blower manifold 38. In this manner, materials placed in the bulk bag and especially hazardous materials that might be placed in a bulk bag may be removed from the exterior of the bulk bag to prevent persons involved in the filling or transportation of bulk bags 14 from coming into contact with the material.

The bag sealing and closing mechanism 28 is preferably a wire tying device of the type commonly used to close bags for containing such items as ice and other bulk commodities. However, it should be understood that the bag sealing and closing mechanism can be any type of closing mechanism suitable for use in this application, including a heat sealing mechanism. Preferably, the bag sealing mechanism 28 will secure the neck 18 closed with an elongated closure member 100 which may be of wire or plastic cord or a plastic tape material. Once the neck 18 of the bulk bag 14 has been closed, the sealing and closing mechanism 28 begins to move back to its resting position. Simultaneously, the cuff 30 is allowed to deflate, thereby releasing the sealed neck 18 of the bulk bag 14 from the rotating spout assembly 16. The now filled and closed bulk bag 14 is then lowered on the lift 27 so that the pallet P upon which the filled bag 14 is supported may exit the bulk bag filling machine 10.

Preferably, a new pallet is moved onto the motorized conveyor 26 at the same time as the pallet P containing the filled bulk bag 14 is being moved off of the motorized conveyor 26. Once the lift 27 has moved the bulk bag 14 to a position where the neck 18 of the bulk bag 14 has been removed from the exterior of the air tube 34, motor 72 is reactivated to spin the air tube 34 back to its ready position. Once the pallet P containing the filled bulk bag 14 has cleared the bulk bag filling machine 10, the filling process may be repeated.

Where hazardous materials such as the powder form of certain chemicals are to be placed within a bulk bag 14, it may be preferable to enclose the bulk bag machine. A suitable enclosure would prevent the hazardous materials from escaping the bulk bag machine 10. Furthermore, it may be desirable to provide the bulk bag machine 10 with a wash-down system. A wash-down system suitable for use with the bulk bag filling machine 10 would be capable of spraying a cleaning substance such as water over the interior of the enclosed bulk bag filling machine 10 to remove any residual hazardous materials that may have escaped from the rotating spout assembly 16 or a bulk bag 14.

The foregoing is considered as illustrative only of the principles of the invention. Furthermore, since numerous modifications and changes will readily occur to those skilled in the art, it is not desired to limit the invention to the exact construction and operation shown and described. Where the preferred embodiment has been described, the details may be changed without departing from the invention, which defined by the claims.

What is claimed is:

1. A bag filling machine comprising:

a supply hopper having a material flow control mechanism connected to an outlet thereof for controlling the flow of material from the hopper; and a rotatable bag filling spout constructed and arranged for rotation about a vertical axis, the rotatable bag filling spout being connected to the material flow control mechanism for conducting material from the supply hopper to a bag that is to be filled, the rotatable bag filling spout being further arranged and constructed to close the bag after it has been filled.

2. The bag filling machine of claim 1 further comprising a bag hanging mechanism for hanging bags to be filled beneath the bag filling spout.

3. The bag filling machine claim 2 wherein the bag hanging mechanism thereof further comprises:

a plurality of bag hanging hooks suspended at a predetermined level for receiving and suspending a bulk bag having an equal number of hook engaging members secured around an upper periphery of the bulk bag wherein at least one of the hooks is stationary and at least one other hook is mounted on a member moveable towards said stationary hook to a first bag receiving position and away from said stationary hook to a second bag filling and release position.

4. The bag filling machine of claim 3 wherein the hook engaging members of the bulk bag comprise a plurality of bag hanging loops secured to the upper periphery of an upper surface of a bulk bag.

5. The bag filling machine of claim 3 wherein a pair of the plurality of hooks of the bag hanging mechanism are mounted on respective moveable members wherein said moveable members are pivotally mounted for swinging movement between the first and second positions.

6. The bag filling machine of claim 5 wherein the hook engaging members of the bulk bag are initially placed on the pair of hooks mounted on the pivotally moveable members when the moveable members are in their first position and wherein the moveable members may be pivoted to their second positions so as to position the suspended bulk bag for filling.

7. The bag filling machine of claim 2 wherein the bag hanging mechanism further comprises:

a pair of front hooks and a pair of rear hooks, each of the pairs of hooks being actuable between a first, bag support position and a second, bag release position;

the rear hooks being further arranged to be swung in a horizontal plane between a first, bag hanging position and a second, bag filling position.

8. The bag filling machine of claim 1 wherein the bag filling spout further comprises:

a vertically oriented inner tube having an upper end and a lower end, the upper end of the inner tube being connected to the material flow control mechanism so as to receive and conduct material to be placed in a bag, the material being discharged from the lower end of the inner tube into the bag;

an outer tube having an upper end and a lower end, the outer tube being received over the vertically oriented inner tube in coaxial relation therewith, the lower end of the outer tube being arranged to have secured thereto a mouth of the bag such that the lower ends of the inner tube and outer tube are disposed within the mouth of the bag to be filled;

a support collar affixed to the upper end of the outer tube, the support collar being constructed and arranged to permit the outer tube to rotate independently of the inner tube; and a rotary actuation mechanism for rotating the outer tube independently of the inner tube.

9. The bag filling machine of claim 8 wherein the rotary actuation mechanism comprises:

a motor having a shaft;

a driving mechanism carried upon the shaft of the motor; and, a driven mechanism on the upper end of the outer tube.

10. The bag filling machine of claim 9 wherein the rotary actuation mechanism further comprises:

a first gear mounted fixedly upon the shaft of the motor;

a second gear secured around the upper end of the outer tube;

a chain secured around the first and second gears so as to transfer rotary motion from the motor to the outer tube; and control means to control the rotation of the outer tube.

11. The bag filling machine of claim 10 wherein the control means comprises:

a hose reel sensor wheel secured to the lever arm of an angular position sensor, the hose reel sensor wheel being biased into contact with the air line wound on the hose reel by the lever arm, the sensor wheel rotating the lever arm of the angular position sensor to determine the length of air line remaining on the first hose reel;

a sensor flag secured to the first hose reel; and a proximity sensor secured adjacent to and in a fixed relation to the first hose reel such that as the first hose reel rotates, the sensor flag passes before the proximity sensor so as to indicate that the first hose reel has made a complete revolution.

12. The bag filling machine of claim 8 further comprising a bladder mechanism received around the lower end of the outer tube for holding the mouth of the bag onto the spout in a bag filling position, the bladder mechanism being inflatable so as to hold the mouth of the bag on the spout.

13. The bag filling machine of claim 12 wherein the bladder mechanism further comprises:

a tubular elastomeric bladder sealingly secured to the lower end of the outer tube;

an air line connected between the bladder and an air supply for inflating the bladder;

a first spout hose reel affixed to the outer tube adjacent the bladder for storage of a predetermined length of the air line;

a second spout hose reel supported external to the bag filling machine for storage of a predetermined length of the air line; and a valve means connected in-line with the airline for inflating and deflating the bladder.

14. The bag filling machine of claim 1 wherein the bag filling spout further comprises:

a vertically oriented fill tube having an upper end and a lower end, the upper end of the fill tube being connected to the material flow control mechanism so as to receive and conduct material to be placed in a bag, the material being discharged from the lower end of the fill tube into the interior of the bag;

a blower manifold positioned adjacent the upper end of the fill tube, the blower manifold having attached thereto a blower means for creating air flow through the manifold;

an outer tube having an upper end and a lower end, the outer tube being received over the vertically oriented fill tube in coaxial relation therewith, so as to form an air space between the fill tube and the outer tube, the upper end of the outer tube extending into the blower manifold such that the air space is in fluidic communication with the blower manifold, the lower end of the outer tube being arranged to have secured thereto the mouth of a bag such that the air space and the fill tube are in communication with the interior of the bag;

a support collar affixed to the upper end of the outer tube, the support collar being constructed and arranged to permit the outer tube to rotate independent of the fill tube; and a rotary actuation mechanism for rotating the outer tube independent of the fill tube.

15. The bag filling machine of claim 14 wherein the blower means comprises at least one blower arranged in fluidic communication with the blower manifold for causing two way air flow through the air space.

16. The bag filling machine of claim 1 further comprising a bag sealing mechanism operable in conjunction with the rotatable bag spout to seal a top of a bag that has been rotated closed by the bag spout.

17. The bag filling machine of claim 16 wherein the bag sealing mechanism further includes a closing mechanism for applying and securing an elongated closure member around a neck of the bag top after the bag neck has been rotated closed by the bag spout.

18. A rotatable spout for filling bags comprising:

a vertically oriented inner tube having an upper end and a lower end, the upper end of the inner tube being connected to a material flow control mechanism so as to receive and conduct material to be placed in a bag from the material flow control mechanism, the material being discharged from the lower end of the inner tube into the bag;

an outer tube having an upper end and a lower end, the outer tube being received over the vertically oriented inner tube in coaxial relation therewith, the lower end of the outer tube being arranged to have secured thereto a mouth of the bag such that the lower ends of the inner tube and outer tube are disposed within the mouth of the bag to be filled;

a support collar affixed to the upper end of the outer tube, the support collar being constructed and arranged to permit the outer tube to rotate independently of the inner tube; and a rotary actuation mechanism for rotating the outer tube independently of the inner tube.

19. The bag filling spout of claim 18 further comprising a bladder mechanism received around the lower end of the outer tube for holding the mouth of the bag to be filled onto the spout in a bag filling position, the bladder mechanism being inflatable so as to hold the mouth of the bag on the spout.

20. The bag filling spout of claim 19 wherein the bladder mechanism further comprises:

a tubular elastomeric bladder sealingly secured to the lower end of the outer tube;

an air line connected between the bladder and an air supply for inflating the bladder;

a first spout hose reel affixed to the outer tube adjacent the bladder for storage of a predetermined length of the air line;

a second spout hose reel supported external to the bag filling machine for storage of a predetermined length of the air line; and a valve means connected in-line with the airline for inflating and deflating the bladder.

21. The bag filling spout of claim 20 wherein the rotary actuation mechanism comprises:

a hose reel sensor wheel secured to a lever arm of an angular position sensor, the hose reel sensor wheel being biased into contact with the air line wound on the hose reel by the lever arm, the sensor wheel rotating the lever arm of the angular position sensor to determine the length of air line remaining on the first hose reel;

a proximity sensor secured to the first hose reel; and a sensor flag secured adjacent to and in a fixed relation to the first hose reel such that as the first hose reel rotates, the sensor flag passes before the proximity sensor so as to indicate that the first hose reel has made a complete revolution.

22. The bag filling machine of claim 18 wherein the rotary actuation mechanism comprises:

a motor having a shaft;

a driving mechanism carried upon the shaft of the motor; and, a driven mechanism on the upper end of the outer tube.

23. The bag filling machine of claim 22 wherein the rotary actuation mechanism further comprises:

a first gear mounted fixedly upon the shaft of the motor;

a second gear secured around the upper end of the outer tube;

a chain secured around the first and second gears so as to transfer rotary motion from the motor to the outer tube; and control means to control the rotation of the outer tube.

24. The bag filling spout of claim 23 wherein the rotary actuation mechanism further comprises:

a rotation sensor operable to sense rotational movement of the spout, said rotation sensor being operatively connected to the motor to stop the motor after a spout has revolved a predetermined number of rotations.

25. The bag filling spout of claim 24 wherein the rotation sensor of the rotary actuation mechanism further comprises a servomechanism operatively connected to the rotation sensor so as to control the rotation of the bag filling spout.

26. The bag filling spout of claim 18 further comprising a bag hanging mechanism for hanging bags below the bag filling spout, the bag hanging mechanism comprising:

a pair of front hooks and a pair of rear hooks, each of the pairs of hooks being actuable between a first, bag support position and a second, bag release position;

the rear hooks being further arranged to be swung in a horizontal plane between a first, bag hanging position and a second, bag filling position.

27. A spout for filling bags comprising:

a vertically oriented fill tube having an upper end and a lower end, the upper end of the fill tube being connected to a material flow control mechanism so as to receive and conduct material to be placed in a bag from the material flow control mechanism, the material being discharged from the lower end of the fill tube into the bag;

a blower manifold positioned adjacent the upper end of the fill tube, the blower manifold having attached thereto a blower means for creating air flow through the manifold;

an outer tube having an upper end and a lower end, the outer tube being received over the vertically oriented fill tube in coaxial relation therewith, so as to form an air space between the fill tube and the outer tube, the upper end of the outer tube extending into the blower manifold such that the air space is in fluidic communication with the blower manifold, the lower end of the outer tube being arranged to have secured thereto a mouth of the bag such that the air space and the fill tube are in communication with the interior of the bag;

a support collar affixed to the upper end of the outer tube, the support collar being constructed and arranged to permit the outer tube to rotate independent of the fill tube; and a rotary actuation mechanism for rotating the outer tube independent of the fill tube.

28. The bag filling spout of claim 27 wherein the blower means comprises at least one blower arranged in fluidic communication with the blower manifold for causing two way air flow through the air space.

29. The bag filling spout of claim 27 further comprising a bladder mechanism received around the lower end of the outer tube for holding the mouth of the bag onto the spout in a bag filling position, the bladder mechanism being inflatable so as to hold the mouth of the bag on the spout.

30. The bag filling spout of claim 29 wherein the bladder mechanism further comprises:

a tubular elastomeric bladder sealingly secured to the lower end of the outer tube;

an air line connected between the bladder and an air supply for inflating the bladder;

a first spout hose reel affixed to the outer tube adjacent the bladder for storage of a predetermined length of the air line;

a second spout hose reel supported external to the bag filling machine for storage of a predetermined length of the air line; and a valve means connected in-line with the airline for inflating and deflating the bladder.

31. The bag filling spout of claim 27 wherein the rotary actuation mechanism comprises:

a motor having a shaft;

a first gear mounted fixedly upon the shaft of the motor;

a second gear secured around the upper end of the outer tube;

a chain secured around the first and second gears so as to transfer rotary motion from the motor to the outer tube; and control means to control the rotation of the outer tube.

32. The bag filling spout of claim 31 wherein the control means comprises:

a hose reel sensor wheel secured to a lever arm of an angular position sensor, the hose reel sensor wheel being biased into contact with an air line wound on a first hose reel by the lever arm, the sensor wheel rotating the lever arm of the angular position sensor to determine a length of air line remaining on the first hose reel;

a sensor flag secured to the first hose reel; and a proximity sensor secured adjacent to and in a fixed relation to the first hose reel such that as the first hose reel rotates, the sensor flag passes before the proximity sensor so as to indicate that the first hose reel has made a complete revolution.

33. The bag filling spout of claim 27 further comprising a bag hanging mechanism for hanging bags below the bag filling spout, the bag hanging mechanism comprising:

a pair of front hooks and a pair of rear hooks, each of the pairs of hooks being actuable between a first, bag support position and a second, bag release position;

the rear hooks being further arranged to be swung in a horizontal plane between a first, bag hanging position and a second, bag filling position.

34. A method of filling a bulk bag with a flowable material wherein the bulk bag comprises an outer shell having a plurality of bag support loops secured thereto for supporting the bulk bag and an inner liner having an elongate neck extending from through the top of the outer shell of the bulk bag, the elongate neck having a mouth at its upper end, the method utilizing a bag filling machine comprising a supply hopper and a rotatable bag filling spout constructed and arranged for rotation about a vertical axis, the rotatable bag filling spout connected to the supply hopper to conduct material from the supply hopper to a bag that is to be filled and a bag hanging mechanism for hanging bags to be filled beneath the bag filling spout, the method comprising the steps of:

hanging the bulk bag beneath the bag filling spout by securing the bag support loops on the bag hanging mechanism;

securing the mouth of the elongate neck of the bulk bag over the spout of the bag filling machine;

filling the bulk bag through its elongate neck;

rotating the spout to twist the elongate neck closed;

applying a closure device to the twisted neck of the inner liner of the bulk bag to seal the bag; and releasing the bulk bag neck and support loops and removing the filled bulk bag from the bag filling machine.

35. The method of filling a bulk bag of claim 34 wherein the spout further comprises a vertically oriented fill tube having an upper end and a lower end, the upper end of the fill tube being connected to a material flow control mechanism so as to receive and conduct material to be placed in a bag from the material flow control mechanism, the material being discharged from the lower end of the fill tube into the bag, a blower manifold positioned adjacent the upper end of the fill tube, the blower manifold having attached thereto a blower means for creating air flow through the manifold, an outer tube having an upper end and a lower end, the outer tube being received over the vertically oriented fill tube in coaxial relation therewith, so as to form an air space between the fill tube and the outer tube, the upper end of the outer tube extending into the blower manifold such that the air space is in fluidic communication with the blower manifold, the lower end of the outer tube being arranged to have secured thereto the mouth of a bag such that the air space and the fill tube are in communication with the interior of the bag, a support collar affixed to the upper end of the outer tube, the support collar being constructed and arranged to permit the outer tube to rotate independently of the fill tube, a rotary actuation mechanism for rotating the outer tube independent of the inner tube, the method further comprising the steps of:

actuating the blower mechanism to at least partially inflate the bulk bag inner liner prior to actuating the material flow control mechanism to fill the bulk bag;

actuating the blower mechanism to alternate between positive and negative airflow simultaneous with the filling of the inner liner of the bulk bag; and, actuating the blower mechanism to create a negative pressure within the filled bulk bag after the bulk bag has been filled.

36. The method of filling a bulk bag of claim 35 wherein the spout further comprises a bladder mechanism received around the lower end of the outer tube for holding the mouth of a bag onto the spout in a bag filling position, the bladder mechanism being inflatable so as to hold the mouth of the bag on the spout and wherein the method of filling bags further comprises the steps of:

inflating the bladder mechanism after the neck of the bulk bag has been placed over the spout to sealingly secure the neck of the bulk bag to the spout and, after the bag has been filled and the neck has been sealed, deflating the bladder mechanism so as to release the bag neck from the spout.

37. In a rotatable bag filling spout comprising a vertically oriented fill tube having an upper end and a lower end, the upper end of the fill tube being connected to a material flow control mechanism so as to receive and conduct material to be placed in a bag from the material flow control mechanism, the material being discharged from the lower end of the fill tube into the bag through a mouth of the bag, an outer tube having an upper end and a lower end, the outer tube being received over the vertically oriented fill tube in coaxial relation therewith, so as to form an air space between the fill tube and the outer tube, the lower end of the outer tube being arranged to have secured thereto the mouth of the bag, a support collar affixed to the upper end of the outer tube, the support collar being constructed and arranged to permit the outer tube to rotate independently of the fill tube, a rotary actuation mechanism for rotating the outer tube independently of the inner tube, and a rotation sensor operable to sense rotational movement of the outer tube, a method of determining a ready position for the outer tube comprising the steps of:

rotating the outer tube in a first predetermined direction until the rotation sensor indicates that outer tube has reached a predetermined home position; and, rotating the outer tube in a second predetermined direction opposite the first predetermined direction of rotation in a manner such that the rotation sensor records a predetermined number of revolutions, the ready position being defined as being the aforesaid predetermined number of revolutions from the home position.

* * * * *